United States Patent [19]

MacGregor

[11] 4,289,070

[45] Sep. 15, 1981

[54] RUBBER STAMP

[75] Inventor: Francis W. MacGregor, New Britain, Conn.

[73] Assignee: Cosco Industries, Inc., New Britain, Conn.

[21] Appl. No.: 52,449

[22] Filed: Jun. 26, 1979

[51] Int. Cl.[3] ..... B41K 1/42

[52] U.S. Cl. ..... 101/327; 101/379

[58] Field of Search ..... 101/379, 380, 327, 405, 101/406, 93.33, 93.34; 400/491, 491.2; 267/158, 164, 165; 200/340

[56] References Cited

U.S. PATENT DOCUMENTS

| | | | |
|---|---|---|---|
| 2,966,116 | 12/1960 | Harris et al. | 101/405 |
| 3,158,094 | 11/1964 | Harris et al. | 101/327 |
| 3,342,911 | 9/1967 | Funahashi | 101/327 |
| 3,358,108 | 12/1967 | Hansen | 200/340 |
| 3,402,663 | 9/1968 | Funahashi | 101/327 |
| 3,421,437 | 1/1969 | Funahashi | 101/327 |
| 3,442,209 | 5/1969 | Funahashi | 101/327 |
| 3,468,252 | 9/1969 | Lemelson | 101/379 |
| 3,478,682 | 11/1969 | Funahashi | 101/327 |
| 3,631,797 | 1/1972 | Johnston et al. | 101/93.33 |
| 3,631,799 | 1/1972 | Funahashi | 101/327 |
| 3,737,605 | 6/1973 | Tobey et al. | 200/340 |
| 3,832,947 | 9/1974 | Funahashi | 101/327 |
| 3,885,495 | 5/1975 | Funahashi | 101/327 |
| 3,952,653 | 4/1976 | McFarland | 101/327 |
| 3,988,987 | 11/1976 | Ikura et al. | 101/327 |
| 4,054,093 | 10/1977 | Funahashi | 101/327 |
| 4,066,860 | 1/1978 | Kawasaki | 200/340 |

FOREIGN PATENT DOCUMENTS

| | | | |
|---|---|---|---|
| 1089531 | 9/1960 | Fed. Rep. of Germany | 267/158 |
| 2384627 | 11/1978 | France | 101/327 |
| 2351794 | 12/1978 | France | 101/327 |
| 1269460 | 4/1972 | United Kingdom | 101/327 |

*Primary Examiner*—William Pieprz

*Attorney, Agent, or Firm*—Senniger, Powers, Leavitt and Roedel

[57] ABSTRACT

An inner frame having upper and lower portions carries an inkable pad in the lower portion thereof. The pad projects below the inner frame for contact with a surface to be stamped. An integral retaining ridge is located on the outer surface of the inner frame between the upper and lower portions. An outer frame is detachably connected to the inner frame and a hollow sleeve member is interposed between the inner and outer frames. The sleeve member has an upper flange which is located above the integral retaining ridge. A plurality of C-shaped resilient fingers integrally molded with the inner frame, outer frame or the sleeve member is located between the upper flange of the sleeve and the inner and outer frames. The lower edge of the sleeve member extends below the level of the inkable pad when the spring member is in the relaxed position. Downward pressure on the outer frame is transmitted by the detachable connection to the inner frame. The result is that the inkable pad contacts a surface to be stamped and the sleeve member telescopes into the inner and outer frames, compressing the C-shaped resilient fingers. Each end of the resilient fingers has a projection with a tapered upper surface and an engaging lower surface facilitating assembly of the structure wherein the sleeve member is slipped over the inner frame so that the flange is located between the projection and the retaining ridge.

12 Claims, 8 Drawing Figures

RUBBER STAMP

BACKGROUND OF THE INVENTION

1. Field of the Invention

The field of invention generally relates to rubber stamping devices and, particularly, relates to a self-inked stamp in a single, unitary structure which is applied to a surface to be stamped and pressed downwardly for contact with the surface.

2. Description of the Prior Art

In the prior art, an ordinary rubber stamp has been made by engraving letters, numerals and other symbols on the surface of a stamp or by applying a rubber plate on the base, such rubber plate being obtained by compressing unvulcanized rubber on the engraved original model and vulcanizing the rubber. In order to use such a rubber stamp, ink must be applied to the surface of the stamp by using a stamp pad for each stamping operation.

The prior art has suggested many types of self-inking stampers which automatically apply ink to the surface of the stamp. For example, reciprocating stampers are well-known in the prior art which, by reciprocating motion, automatically contact a stamping pad after each stamping operation to ink the surface of the pad after each stamping operation and prepare it for the following stamping operation.

U.S. Pat. No. 3,402,663, issued to Takaji Funahashi, incorporated herein in its entirety by reference, suggests the use of a stamp pad having an ink pad and stamp plate secured in a lower compartment beneath a transverse wall of an inner frame. An outer frame of the stamp is telescoped over the inner frame and engages a spring acting on a sleeve which is interposed between the inner and outer frames and which has a lower edge extending below the plate when the spring is relaxed. By downwardly applying pressure to the stamp device as disclosed in U.S. Pat. No. 3,402,663, the surface of the stamp can selectively contact a piece of paper or other surface to be stamped so that repeated stamping operations may occur.

However, the Funahashi structure suffers from the fact that it requires extremely complex elements to achieve the structural result desired and it is very difficult to assemble these desired elements in an efficient manner.

SUMMARY OF THE INVENTION

It is an object of this invention to disclose a rubber stamp comprised of four structural elements which can be molded and quickly assembled without difficulty.

It is a further object of this invention to disclose an inner frame for a rubber stamp structure which integrally includes spring means for biasing a downwardly projecting sleeve member of the rubber stamp.

It is a further object of this invention to describe a rubber stamp having an inner frame with integral spring means located within an aperture for biasing a hollow sleeve member projecting from the base of the rubber stamp.

It is a further object of this invention to disclose a rubber stamp having integral spring means comprising a plurality of C-shaped resilient fingers with projections at their ends for biasing a hollow sleeve member down to a lowered position where it extends below the rubber stamp and the inner and outer frames of the rubber stamp.

Briefly, the stamp of this invention comprises an inner frame or member having a generally tubular body with a ridge thereon above its lower end, an inkable pad in the inner member having an indicia-bearing portion extending below the lower end of the inner member, and a sleeve member comprising a tubular body carried on the inner member in telescoping relationship therewith and having a flange engageable with the ridge. The sleeve member is movable with respect to the inner member between a lowered position where its flange engages the ridge on the inner member and its lower end extends down beneath the indicia-bearing portion of the inkable pad and a raised position where its lower end is substantially level with the indicia-bearing portion for exposing the indicia-bearing portion. Means is provided for biasing the sleeve member to its lowered position comprising spring means integral with one of the members and having a laterally extending projection engageable with the other members.

Other objects and features will be in part apparent and in part pointed out hereinafter.

DETAILED DESCRIPTION OF THE INVENTION

Figure 1:
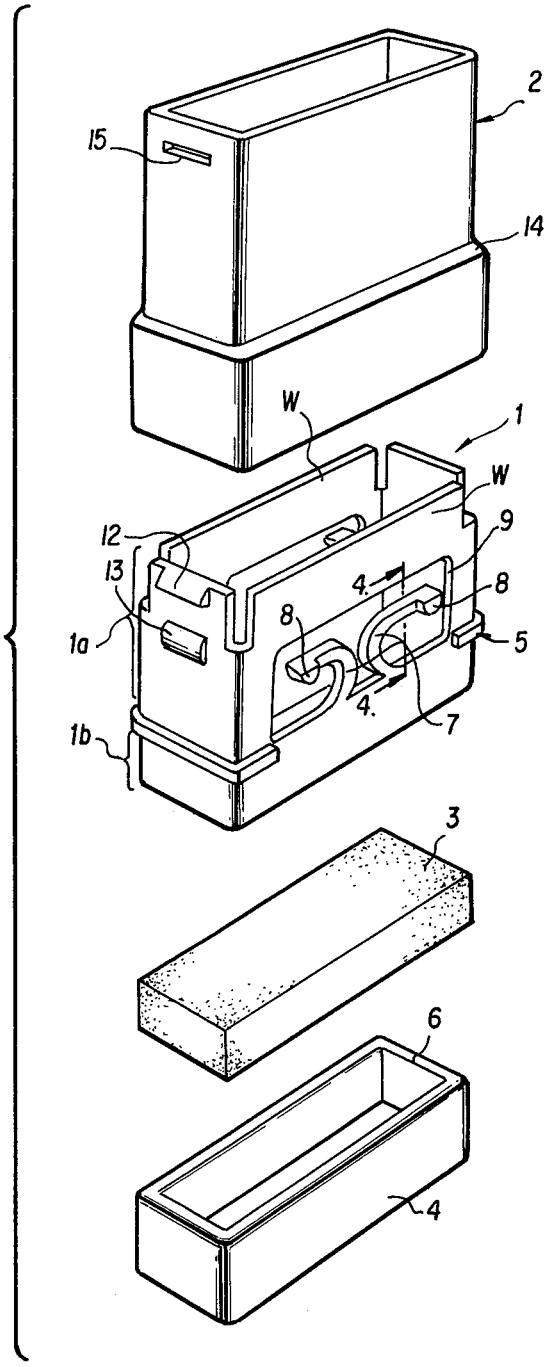
FIG. 1 is a perspective view of one embodiment of the rubber stamp according to the invention in unassembled condition.

It is contemplated that the rubber stamp according to the invention is specifically comprised of four interlocking portions: inner member or frame 1, outer member or frame 2, inkable pad 3, and hollow sleeve member 4. The basis of the invention and one of the most critical features is the unitary, integral structure of biasing means located between the sleeve 4 and inner frame 1 or outer frame 2. Preferably, the inner frame is comprised of an upper portion 1*a* and a lower portion 1*b*. The lower portion 1*b* carries the inkable pad 3. The inked dye 3 may be held in position in the lower portion 1*b* of the inner frame 1 by means of a retaining ring, not shown, or merely by a compression fit within the lower portion 1*b*.

Figure 3:
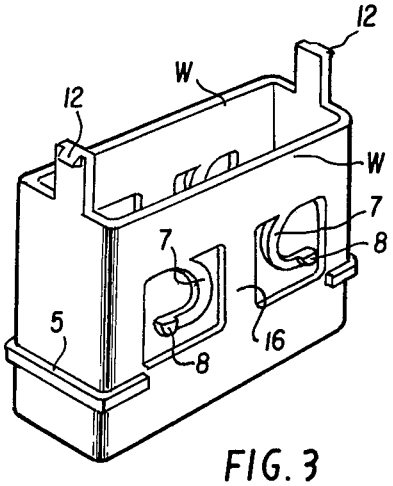
FIG. 3 is a perspective view of another embodiment of the inner member according to the invention.

As shown in FIGS. 1 and 3, between the upper portion 1*a* and lower portion 1*b* of the inner frame 1, an integral retaining ridge 5 is located on the outer surface of the inner frame. The upper portion 1*a* of the inner frame further includes an aperture 9 having integral spring means constituting the biasing means. The spring means comprises a plurality of C-shaped resilient fingers 7 each having a projection 8 at the end thereof. In the embodiment of FIGS. 1 and 3, the resilient fingers 7 are located in opposing walls W in the same plane as the walls W. Therefore, each finger 7 travels within the plane of the respective wall W and the projection 8 thereon projects from this plane.

Figure 4:
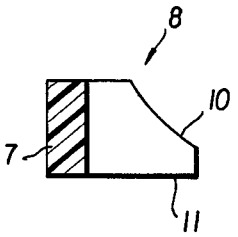
FIG. 4 is a cross-sectional view taken along lines 4—4 of FIG. 1 showing the projection on the end of one of the integral resilient fingers constituting the biasing means.

The particular structure of the projections 8 can be best appreciated by referring to FIG. 4. Each projection 8 has an upper surface 10 which is downwardly tapered and a lower engaging surface 11 which is of horizontal or slightly concave configuration. The upper edge of hollow sleeve member 4 has an inwardly folded-over edge or flange 6. In assembly, the hollow sleeve member 4 is slipped over the top of inner frame 1 and over upper portion 1*a*. The flange 6 contacts the upper surface 10 of the knob 8 as the hollow sleeve member 4 is slipped over the inner frame 1 forcing the integral resilient fingers 7 inward. The result is that the hollow sleeve member 4 is slipped over the inner frame 1 so that the flange 6 is located between the lower engaging surface 11 of the projection 8 and the retaining ridge 5.

The outer frame 2 detachably engages the inner frame 1 by means of projections 12 and 13. Projection 12 is configured to engage the slot 15 in the side of the outer frame 2, and projection 13 is provided to align the inner frame with respect to the outer frame. The lower portion of the outer frame may be flared outwardly and include a shoulder 14 so that the hollow sleeve member 4 is located between the inner and outer frames. However, it is contemplated that the outer frame 2 may have an outer box-like shape as the shoulder 14 provides no particular function and is a matter of convenience. Alternatively, the outer frame 2 may have members, not shown, which project inwardly from the top of the outer frame 2 to further support the inkable pad 3 within the inner frame 1.

Figure 2:
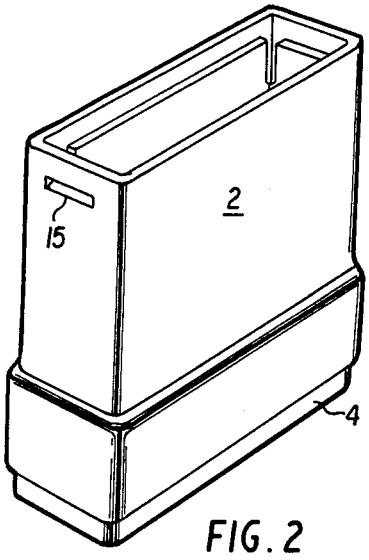
FIG. 2 is a perspective view of the rubber stamp according to the invention in assembled condition.

As shown in the assembled condition illustrated in FIG. 2, downward pressure on the outer frame 2 is translated via the projections 12 to inner frame 1. The downward pressure on the inner and outer frames creates relative movement between the hollow sleeve member 4 and the inner and outer frames. In effect, the hollow sleeve member 4 moves upward between the inner and outer frames. This upward movement causes the flange 6 of the sleeve member to engage the lower engaging surfaces 11 of the projections 8 thereby flexing and expanding the C-shaped integral resilient fingers 7. This result is due to the fact that the hollow sleeve member 4 is configured to project below the pad 3 and the lower edges of inner frame 1 and outer frame 2 when the integral resilient fingers 7 are in a relaxed position.

FIG. 3 illustrates another embodiment of the inner frame 2 wherein the integral resilient fingers 7 project from the upper portion of the apertures 9 formed within the inner frame 1. To further enhance the strength of the inner frame 1 illustrated in FIG. 3, a support 16 is located between the integral resilient fingers 7. In the embodiment illustrated in FIG. 3, it is contemplated that the outer frame for use therewith may have an open top. The projections 12 would fit over the open top of the outer frame and a cover, not shown, would be located between the projections to lock the entire structure into a unitary system.

As can be appreciated from the drawings, the inner frame is constituted as a hollow box-like member and the outer frame is constituted as a corresponding hollow box-like member.

Figure 5:
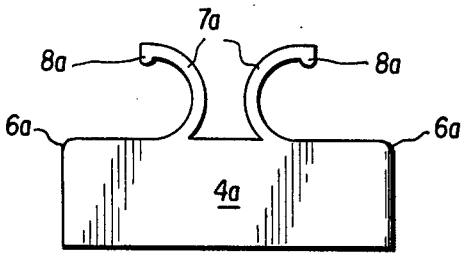
FIG. 5 is a front view of an alternative embodiment of the invention wherein the biasing means forms an integral part of the sleeve member.
Figure 6A:
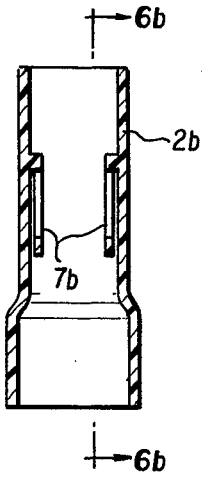
FIGS. 6*a* and 6*b* are a transverse and longitudinal cross-sectional view, respectively, of another alternative embodiment of the invention wherein the biasing means forms an integral part of the outer member.
Figure 6B:
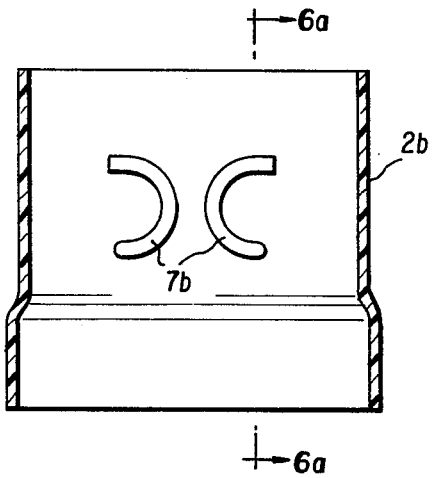
Figure 7:
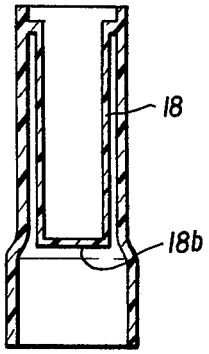
FIG. 7 is a transverse cross-sectional view of another alternative embodiment of the invention wherein the outer member is integrally provided with a U-shaped ejecting support.

FIGS. 5–7 illustrate alternative embodiments and features of the invention. In FIG. 5, the biasing means is shown as an integral part of the sleeve. In particular, sleeve 4*a* has a flange 6*a* which carries a plurality of integral C-shaped resilient fingers 7*a*. Each finger 7*a* terminates in an inwardly projecting projection 8*a* which engages an aperture or opening in the inner frame. Alternatively, the projection 8*a* may project outwardly and engage apertures or openings in the outer frame or projections (not shown) may be located on the inner and outer frames to engage the end of the fingers 7*a*.

In FIGS. 6*a* and 6*b*, the biasing means is shown as an integral with the outer frame 2*b*. The C-shaped resilient fingers 7*b* each have a lower portion which engages the flange of the sleeve member.

One feature of the invention which may be employed with any of the above embodiments is a U-shaped ejecting support 18 which is an integral part of the outer frame 2. In assembled condition, the support 18 would be within the inner frame 1 and the base 18*b* of the support would be in contact with the inkable pad 3. In this way, the support provides a level backplate which holds the pad in place and presses the pad in an even and flat manner.

It is contemplated that the entire structure may be made of plastic or metal or a combination of both types of materials. Preferably, the inner frame 1 and outer frame 2 are comprised of molded plastic and the hollow sleeve member 4 is formed of sheet metal. The inkable pad 3 may be any well-known, prior art porous material ink carrier having a stamp projecting from the bottom surface thereof. It is further contemplated that the structure may be used with multi-colored stamping systems and may be employed with reinking and self-inking structures.

Various changes may be made in the details of the invention, as disclosed, without sacrificing the advantages thereof or departing from the scope of the appended claims. Furthermore, although the present invention has been disclosed and discussed with particular regard to its exceptional advantages in terms of rubber stamps, it may be understood that the invention may be employed in several industrial applications wherein inner and outer telescoping members are engaged and carry a biased hollow sleeve member therebetween.

What is claimed is:

1. A stamp which comprises:

an inner member comprising a generally tubular body having a ridge thereon above its lower end;

an inkable pad in the inner member having an indicia-bearing portion extending below the lower end of the inner member;

a sleeve member comprising a tubular body carried on the inner member in telescoping relationship therewith and having a flange engageable with the ridge, the sleeve member being movable with respect to the inner member between a lowered position where its flange engages the ridge on the inner member and its lower end extends beneath the indicia-bearing portion of the inkable pad and a raised position where its lower end is substantially level with the indicia-bearing portion for exposing said portion; and means for biasing the sleeve member to its lowered position comprising a resilient finger integral with the inner member, disposed in an aperture in a side wall of the inner member, and extending generally in the plane of the wall, the finger having a projection at the end thereof extending laterally outwardly toward the sleeve member and being engageable with the flange on the sleeve member.

2. A stamp as set forth in claim 1 wherein the inner member is generally rectangular in section, the spring means comprising a pair of C-shaped resilient fingers at opposite sides of the inner member.

3. A stamp which comprises:

an inner member comprising a generally tubular body having a ridge thereon above its lower end;

an inkable pad in the inner member having an indicia-bearing portion extending below the lower end of the inner member;

a sleeve member comprising a tubular body carried on the inner member in telescoping relationship therewith and having a flange engageable with the ridge, the sleeve member being movable with respect to the inner member between a lowered position where its flange engages the ridge on the inner member and its lower end extends beneath the indicia-bearing portion of the inkable pad and a raised position where its lower end is substantially level with the indicia-bearing portion for exposing said portion; and means for biasing the sleeve member to its lowered position comprising spring means integral with the sleeve member and having a projection extending laterally inwardly into an opening in the inner member.

4. A stamp as set forth in claim 3 wherein the spring means comprises a C-shaped resilient finger extending upwardly in the plane of a side wall of the sleeve member, the projection being at the end of the finger.

5. A stamp as set forth in claim 4 wherein the sleeve member is generally rectangular in section, the spring means comprising a pair of resilient fingers at opposite sides of the sleeve member.

6. A stamp which comprises:

an inner member comprising a generally tubular body;

an outer member comprising a generally tubular body, the inner member being detachably secured to the outer member with the inner surface of the outer member at a lower portion thereof being spaced from the outer surface of the inner member, one of the members having a ridge thereon extending laterally into the space between the members;

an inkable pad in the inner member having an indicia-bearing portion extending below the lower ends of the inner and outer members;

a sleeve member comprising a tubular body extending up in the space between the inner and outer members and having a flange engageable with said ridge, the sleeve member being movable in said space with respect to the inner and outer members between a lowered position where its flange engages said ridge and its lower end extends below the indicia-bearing portion of the inkable pad and a raised position where its lower end is substantially level with the indicia-bearing portion for exposing said portion; and means for biasing the sleeve member to its lowered position comprising a resilient finger integral with the inner member, disposed in an aperture in the side wall of the inner member, and extending generally in the plane of the wall, the finger having a projection at the end thereof extending laterally outwardly toward the sleeve member and being engageable with the flange on the sleeve member.

7. A stamp as set forth in claim 6 wherein the inner member is generally rectangular in section, the spring means comprising a pair of C-shaped resilient fingers at opposite sides of the inner member.

8. A stamp which comprises:

an inner member comprising a generally tubular body;

an outer member comprising a generally tubular body, the inner member being detachably secured to the outer member with the inner surface of the outer member at a lower portion thereof being spaced from the outer surface of the inner member, one of the members having a ridge thereon extending laterally into the space between the members;

an inkable pad in the inner member having an indicia-bearing portion extending below the lower ends of the inner and outer members;

a sleeve member comprising a tubular body extending up in the space between the inner and outer members and having a flange engageable with said ridge, the sleeve member being movable in said space with respect to the inner and outer members between a lowered position where its flange engages said ridge and its lower end extends below the indicia-bearing portion of the inkable pad and a raised position where its lower end is substantially level with the indicia-bearing portion for exposing said portion; and means for biasing the sleeve member to its lowered position comprising spring means integral with the sleeve member and having a projection extending laterally outwardly and being received in an opening in the outer member.

9. A stamp which comprises:

an inner member comprising a generally tubular body;

an outer member comprising a generally tubular body, the inner member being detachably secured to the outer member with the inner surface of the outer member at a lower portion thereof being spaced from the outer surface of the inner member, one of the members having a ridge thereon extending laterally into the space between the members;

an inkable pad in the inner member having an indicia-bearing portion extending below the lower ends of the inner and outer members;

a sleeve member comprising a tubular body extending up in the space between the inner and outer members and having a flange engageable with said ridge, the sleeve member being movable in said space with respect to the inner and outer members between a lowered position where its flange engages said ridge and its lower end extends below the indicia-bearing portion of the inkable pad and a raised position where its lower end is substantially level with the indicia-bearing portion for exposing said portion; and means for biasing the sleeve member to its lowered position comprising spring means integral with the sleeve member and having a projection extending laterally inwardly and being received in an opening in the inner member.

10. A stamp as set forth in claim 8 or 9 wherein the spring means extends upwardly between the inner and outer members in the plane of a side wall of the sleeve member.

11. A stamp as set forth in claim 10 wherein the spring means comprises a C-shaped resilient finger, the projection being at the end of the finger.

12. A stamp as set forth in claim 11 wherein the sleeve member is generally rectangular in section, the spring means comprising a pair of resilient fingers on opposite sides of the sleeve member.

* * * * *